US009884401B2

(12) United States Patent
Fukushima et al.

(10) Patent No.: US 9,884,401 B2
(45) Date of Patent: Feb. 6, 2018

(54) ELASTIC MEMBRANE AND SUBSTRATE HOLDING APPARATUS

(71) Applicant: EBARA CORPORATION, Tokyo (JP)

(72) Inventors: Makoto Fukushima, Tokyo (JP); Hozumi Yasuda, Tokyo (JP); Osamu Nabeya, Tokyo (JP); Shingo Togashi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/011,626

(22) Filed: Aug. 27, 2013

(65) Prior Publication Data

US 2014/0065934 A1 Mar. 6, 2014

(30) Foreign Application Priority Data

Aug. 28, 2012 (JP) ..... 2012-187118
Aug. 12, 2013 (JP) ..... 2013-167273

(51) Int. Cl.
*B24B 37/30* (2012.01)

(52) U.S. Cl.
CPC ..... *B24B 37/30* (2013.01)

(58) Field of Classification Search
CPC ..... B24B 37/30; B24B 37/32; B24B 41/061; B24B 49/16
USPC ..... 451/288, 398, 388, 289, 286
See application file for complete search history.

(56) References Cited

U.S. PATENT DOCUMENTS 6,080,050 A * 6/2000 Chen et al. ..... 451/288
6,390,905 B1 * 5/2002 Korovin et al. ..... 451/286
6,659,850 B2 * 12/2003 Korovin et al. ..... 451/286
6,764,387 B1 * 7/2004 Chen ..... 451/41
6,852,019 B2 * 2/2005 Togawa et al. ..... 451/288
6,857,945 B1 * 2/2005 Chen et al. ..... 451/288
7,025,664 B2 * 4/2006 Korovin et al. ..... 451/289
7,163,895 B2 * 1/2007 Togawa et al. ..... 438/692
7,207,871 B1 * 4/2007 Zuniga et al. ..... 451/288
(Continued)

FOREIGN PATENT DOCUMENTS

CN 101444897 A 6/2009
JP 2009-131920 6/2009
(Continued)

OTHER PUBLICATIONS

European Patent Application No. 13020084.3; Extended European Search Report; dated Apr. 28, 2015; 8 pages.

*Primary Examiner* — Marc Carlson
(74) *Attorney, Agent, or Firm* — Baker & Hostetler LLP

(57) ABSTRACT

An elastic membrane is used in a substrate holding apparatus for holding a substrate such as a semiconductor wafer and pressing the substrate against a polishing surface. The elastic membrane includes a plurality of concentrically circumferential walls configured to define a plurality of pressurizing areas for pressing the substrate. The pressurizing areas includes a central pressurizing area located at a central part of the elastic membrane, an annular edge pressurizing area located at the outermost part of the elastic membrane, and a plurality of intermediate pressurizing areas located between the central pressurizing area and the annular edge pressurizing area. The area width of at least one of the intermediate pressurizing areas is set in a range to allow a polishing rate responsive width not to vary even when the area width is varied.

12 Claims, 14 Drawing Sheets

(56) References Cited

U.S. PATENT DOCUMENTS 7,303,466 B2 * 12/2007 Boo et al. ..... 451/285
7,311,585 B2 * 12/2007 Togawa et al. ..... 451/41
7,357,699 B2 * 4/2008 Togawa ..... B24B 37/30 451/288
7,402,098 B2 * 7/2008 Severson et al. ..... 451/288
7,491,117 B2 * 2/2009 Togawa et al. ..... 451/288
7,632,173 B2 * 12/2009 Togawa et al. ..... 451/289
7,988,537 B2 * 8/2011 Togawa et al. ..... 451/288
8,070,560 B2 * 12/2011 Yasuda et al. ..... 451/289
8,100,739 B2 * 1/2012 Yasuda et al. ..... 451/5
8,485,866 B2 * 7/2013 Yasuda et al. ..... 451/288
8,845,396 B2 * 9/2014 Nabeya et al. ..... 451/287
8,859,070 B2 * 10/2014 Yasuda ..... B32B 3/08 428/201
2005/0107015 A1 * 5/2005 Togawa et al. ..... 451/285
2005/0118935 A1 * 6/2005 Togawa et al. ..... 451/41
2005/0272346 A1 * 12/2005 Boo ..... B24B 37/30 451/6
2006/0019582 A1 * 1/2006 Chen ..... B24B 37/345 451/41
2007/0082589 A1 * 4/2007 Zuniga ..... B24B 49/16 451/288
2007/0111637 A1 * 5/2007 Togawa ..... B24B 37/30 451/1
2009/0061748 A1 * 3/2009 Togawa et al. ..... 451/364
2009/0142996 A1 * 6/2009 Yasuda ..... B24B 37/30 451/60
2009/0233532 A1 * 9/2009 Togawa et al. ..... 451/288
2010/0056028 A1 * 3/2010 Togawa et al. ..... 451/398
2011/0159783 A1 * 6/2011 Fukushima et al. ..... 451/11
2012/0058709 A1 * 3/2012 Fukushima et al. ..... 451/5
2013/0136884 A1 * 5/2013 Yasuda et al. ..... 428/64.1
2014/0004779 A1 * 1/2014 Namiki et al. ..... 451/365

FOREIGN PATENT DOCUMENTS

JP 2013-111679 6/2013
TW 201205704 A 2/2012

* cited by examiner

ELASTIC MEMBRANE AND SUBSTRATE HOLDING APPARATUS

CROSS REFERENCE TO RELATED APPLICATIONS

This document claims priorities to Japanese Application Number 2012-187118, filed Aug. 28, 2012 and Japanese Patent Application Number 2013-167273, filed Aug. 12, 2013, the entire contents of which are hereby incorporated by reference.

BACKGROUND OF THE INVENTION

Field of the Invention

The present invention relates to an elastic membrane for use in a substrate holding apparatus for holding a substrate such as a semiconductor wafer and pressing the substrate against a polishing surface in a polishing apparatus for polishing and planarizing the substrate. Further, the present invention relates to a substrate holding apparatus having such elastic membrane.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) therein is supplied onto a polishing surface such as a polishing pad, a substrate such as a semiconductor wafer is brought into sliding contact with the polishing surface and polished using the polishing apparatus.

This kind of polishing apparatus includes a polishing table having a polishing surface formed by a polishing pad, and a substrate holding apparatus for holding a substrate such as a semiconductor wafer. When the semiconductor wafer is polished with such a polishing apparatus, the semiconductor wafer is held and pressed against the polishing surface under a predetermined pressure by the substrate holding apparatus. At this time, the polishing table and the substrate holding apparatus are moved relative to each other to bring the semiconductor wafer into sliding contact with the polishing surface, so that the surface of the semiconductor wafer is polished to a flat mirror finish.

In such polishing apparatus, if a polishing rate of the semiconductor wafer is not uniform over the entire surface of the semiconductor wafer, then the semiconductor wafer is insufficiently or excessively polished depending on the polishing rate of each area of the semiconductor wafer. Therefore, there has been known a polishing apparatus in which a plurality of concentric pressure chambers defined by an elastic membrane are provided at a lower portion of the substrate holding apparatus, and by controlling pressures of pressurized fluid supplied to the respective pressure chambers, the semiconductor wafer is pressed against the polishing surface under different pressures at respective pressurizing areas, along a radial direction of the semiconductor wafer, corresponding to the respective pressure chambers.

FIG. 1 shows an example of a substrate holding apparatus of the above polishing apparatus. As shown in FIG. 1, the substrate holding apparatus has an apparatus body 200, a retainer ring 202, and an elastic membrane 204 provided on a lower surface of the apparatus body 200. On an upper surface of the elastic membrane 204, a plurality of (four in the figure) concentric circumferential walls 204*a*, 204*b*, 204*c* and 204*d* are provided. By these concentric circumferential walls 204*a*, 204*b*, 204*c* and 204*d*, a circular central pressure chamber 206 located at a central part of the semiconductor wafer W, an annular edge pressure chamber 208 located at the outermost part of the semiconductor wafer W, and two annular intermediate pressure chambers 210, 212 located between the central pressure chamber 206 and the edge pressure chamber 208 are formed between the upper surface of the elastic membrane 204 and the lower surface of the apparatus body 200.

With this configuration, the semiconductor wafer W is held by the substrate holding apparatus in such a state that there are four divided pressurizing areas, on the elastic membrane 204, comprising a circular central pressurizing area CA corresponding to the central pressure chamber 206, an annular edge pressurizing area EA corresponding to the edge pressure chamber 208, and two annular intermediate pressurizing areas MA1, MA2 corresponding to the intermediate pressure chambers 210, 212.

In the apparatus body 200, a passage 214 communicating with the central pressure chamber 206, a passage 216 communicating with the edge pressure chamber 208, and passages 218, 220 communicating respectively with the intermediate pressure chambers 210, 212 are formed. The respective passages 214, 216, 218 and 220 are connected via respective passages 222, 224, 226 and 228 to a fluid supply source 230. Further, opening and closing valves V10, V11, V12 and V 13 and pressure regulators R10, R11, R12 and R13 are provided in the passages 222, 224, 226 and 228, respectively.

The respective pressure regulators R10, R11, R12 and R13 have pressure adjusting function for adjusting pressures of pressurized fluid to be supplied from the fluid supply source 230 to the respective pressure chambers 206, 208, 210 and 212. The pressure regulators R10, R11, R12 and R13 and the opening and closing valves V10, V11, V12 and V13 are connected to a controller 232, and operations of these pressure regulators and these valves are controlled by the controller 232.

With this arrangement, by controlling respective pressures of the pressurized fluid to be supplied to the respective pressure chambers 206, 208, 210 and 212 in such a state that the semiconductor wafer W is held by the substrate holding apparatus, the semiconductor wafer W can be pressed against the polishing surface (not shown) under different pressures at the respective pressurizing areas CA, EA, MA1 and MA2 on the elastic membrane 204 along a radial direction of the semiconductor wafer W.

In order to transmit the fluid pressures of the pressure chambers 206, 208, 210 and 212 defined on the upper surface of the elastic membrane 204 toward the semiconductor wafer W efficiently and to press the semiconductor wafer under a uniform pressure from the central part to the edge part of the semiconductor wafer W, a flexible material such as rubber is generally used for the elastic membrane 204.

In the case where a substrate such as a semiconductor wafer is held and pressed against the polishing surface to be polished by such substrate holding apparatus, if different pressures of the pressurized fluid are applied to two adjacent pressure chambers, then there occurs a step-like difference in pressing pressures (polishing pressures) for pressing the substrate in two adjacent pressurizing areas. As a result, a step-like height difference is produced also in polishing configuration (polishing profile). In this case, if there is a large pressure difference in pressures of the pressurized fluid supplied to the two adjacent pressure chambers, the step-like height difference in polishing configuration (polishing profile) becomes larger depending on the pressure difference in pressures for pressing the substrate in the two adjacent pressurizing areas.

Therefore, the applicant of the present invention has proposed to provide a diaphragm onto the elastic membrane so as to exist on both sides of the boundary between the two adjacent pressure chambers, the diaphragm being composed of a material having higher rigidity (large modulus of longitudinal elasticity) than the elastic membrane, as disclosed in Japanese laid-open patent publication No. 2009-131920.

FIG. 2 is a graph showing the relationship between locations along a radial direction of a semiconductor wafer and a polishing rate when the semiconductor wafer is held and polished by the substrate holding apparatus shown in FIG. 1, while the pressures of the pressurized fluid supplied to the respective pressure chambers 206, 208, 210 and 212 are equalized. As shown by a solid line A in FIG. 2, there are cases where the polishing rate is gradually decreased toward a radially outward direction of the semiconductor wafer. With respect to radial locations of the semiconductor wafer in FIG. 2, the areas CA, MA1 and MA2 along a radial direction of the semiconductor wafer correspond to respective pressurizing areas CA, MA1 and MA2 on the elastic membrane 204 shown in FIG. 1.

In such case, when the pressures of the pressurized fluid supplied to the intermediate pressure chambers 210, 212 are increased to increase the polishing rate in the areas of the semiconductor wafer corresponding to the intermediate pressurizing areas MA1, MA2, as shown by a dotted-dashed line B in FIG. 2, the polishing rate in the areas corresponding to the intermediate pressurizing areas MA1, MA2 is increased as a whole, but the inclination of the polishing rate in the intermediate pressurizing areas MA1, MA2 is substantially the same as the inclination of the polishing rate shown by the solid line A showing the case where the pressures of the pressurized fluid supplied to the intermediate pressure chambers 210, 212 are not increased. That is, the polishing rate in the intermediate pressurizing areas MA1, MA2 is increased in parallel at approximately the same rate while keeping the inclination of the polishing rate approximately constant.

Accordingly, the range of polishing rate distribution (variation range of polishing rate) over the entire surface of the semiconductor wafer is narrowed, however the range of polishing rate distribution (variation range of polishing rate) along a radial direction of the semiconductor wafer in the respective pressurizing areas, e.g. in the intermediate pressurizing area MA1, is not narrowed even when the pressure of the pressurized fluid is increased. Therefore, by the size of the radial area width of the pressurizing area MA1, the enhancement of uniformity of the surface, being polished, of the semiconductor wafer is hindered and the improvement of yield is limited.

SUMMARY OF THE INVENTION

The present invention has been made in view of the above circumstances. It is therefore an object of the present invention to provide an elastic membrane for use in a substrate holding apparatus of a polishing apparatus which can narrow the range of polishing rate distribution (variation range of polishing rate) in areas of a substrate corresponding to pressurizing areas concentrically disposed along a radial direction of the substrate, thus enhancing uniformity of a surface, being polished, of the substrate and improving yield. Further, it is another object of the present invention to provide a substrate holding apparatus having such elastic membrane.

In order to achieve the above object, according to an aspect of the present invention, there is provided an elastic membrane for use in a substrate holding apparatus for holding a substrate, the elastic membrane comprising: a plurality of concentrically circumferential walls configured to define a plurality of pressurizing areas for pressing the substrate, the plurality of pressurizing areas comprising a central pressurizing area located at a central part of the elastic membrane, an annular edge pressurizing area located at the outermost part of the elastic membrane, and a plurality of intermediate pressurizing areas located between the central pressurizing area and the annular edge pressurizing area; wherein a radial area width of at least one of the intermediate pressurizing areas is set in a range to allow a polishing rate responsive width not to vary even when the radial area width is varied.

Hereinafter, the radial area width of each of the pressurizing areas may be simply referred to as an area width.

The polishing rate responsive width corresponds to a radial area of the substrate determined in each of the plurality of intermediate pressurizing areas; and an absolute value of variation between a polishing rate when the substrate is polished under certain pressure condition and a polishing rate when the substrate is polished under pressure condition changed by a predetermined pressure from the certain pressure condition in each of the intermediate pressurizing areas is calculated, and the radial area of the substrate in which the absolute value of the polishing rate variation is not less than 20% and not more than 100% with respect to a maximum absolute value of the polishing rate variation in each of the intermediate pressurizing areas is defined as the polishing rate responsive width.

Examples of the above certain pressure condition include pressure condition adjusted such that the polishing rates in the respective intermediate pressurizing areas are equalized, but are not necessarily required to be pressures adjusted by constant condition.

According to the present invention, the at least one of the intermediate pressurizing areas whose area width is set in the range to allow the polishing rate responsive width not to vary even when the area width is varied, comprises at least two of the plurality of intermediate pressurizing areas which are adjacent to each other.

With such configuration, by setting the area width of at least one of the plurality of intermediate pressurizing areas, e.g. at least two of the plurality of intermediate pressurizing areas adjacent to each other, in the range to allow the polishing rate responsive width not to vary even when the area width is varied, the range of polishing rate distribution (variation range of polishing rate) in the intermediate pressurizing area whose area width has been set in such a manner can be narrowed to enhance uniformity of a surface, being polished, of the substrate and improve yield.

When the elastic membrane is used for a substrate holding apparatus for holding a semiconductor wafer having a diameter of 300 mm, the area width of at least one of the intermediate pressurizing areas or at least two of the intermediate pressurizing areas which are adjacent to each other, is preferably set in a range of not less than 2 mm and not more than 15 mm.

When the elastic membrane is used for a substrate holding apparatus for holding a semiconductor wafer having a diameter of 300 mm, the area width of at least one of the intermediate pressurizing areas located at an outer circumferential side may be set in a range of not less than 2 mm and not more than 15 mm, and the area width of the intermediate pressurizing area located at a radially inner side of the intermediate pressurizing area having the area width set in a range of not less than 2 mm and not more than 15 mm, may be set in a range of not less than 2 mm and not more than 20 mm.

When the elastic membrane is used for a substrate holding apparatus for holding a semiconductor wafer having a diameter of 450 mm, the area width of at least one of the intermediate pressurizing areas or at least two of the intermediate pressurizing areas which are adjacent to each other, is preferably set in a range of not less than 2 mm and not more than 26 mm.

When the elastic membrane is used for a substrate holding apparatus for holding a semiconductor wafer having a diameter of 450 mm, the area width of at least one of the intermediate pressurizing areas located at an outer circumferential side may be set in a range of not less than 2 mm and not more than 26 mm, and the area width of the intermediate pressurizing area located at a radially inner side of the intermediate pressurizing area having the area width set in the range of not less than 2 mm and not more than 26 mm, may be set in a range of not less than 2 mm and not more than 34 mm.

According to another aspect of the present invention, there is provided an elastic membrane for use in a substrate holding apparatus for holding a semiconductor wafer having a thickness t (μm), Young's modulus E (MPa), the elastic membrane comprising: a plurality of concentrically circumferential walls configured to define a plurality of pressurizing areas for pressing the semiconductor wafer, the plurality of pressurizing areas comprising a central pressurizing area located at a central part of the elastic membrane, an annular edge pressurizing area located at the outermost part of the elastic membrane, and a plurality of intermediate pressurizing areas located between the central pressurizing area and the annular edge pressurizing area; wherein an area width of at least one of the intermediate pressurizing areas is set in a range to allow a polishing rate responsive width not to vary even when the area width is varied; and the area width of the at least one of the intermediate pressurizing areas is set in the range of not less than 2 mm and not more than EWb (mm) defined in the following formula;

$$EWb=15\times(t/775)^3\times(E/194000).$$

According to another aspect of the present invention, there is provided a substrate holding apparatus for holding a substrate to be polished and pressing the substrate against a polishing surface, comprising: an elastic membrane; an apparatus body for holding the elastic membrane; a plurality of pressure chambers partitioned by a plurality of concentrically circumferential walls of the elastic membrane between the elastic membrane and a lower surface of the apparatus body, the substrate being held by a lower surface of the elastic membrane and being pressed against the polishing surface with a fluid pressure by supplying a pressurized fluid to the plurality of pressure chambers; the plurality of concentrically circumferential walls being configured to define a plurality of pressurizing areas for pressing the substrate, the plurality of pressurizing areas comprising a central pressurizing area located at a central part of the elastic membrane, an annular edge pressurizing area located at the outermost part of the elastic membrane, and a plurality of intermediate pressurizing areas located between the central pressurizing area and the annular edge pressurizing area; wherein an area width of at least one of the intermediate pressurizing areas is set in a range to allow a polishing rate responsive width not to vary even when the area width is varied.

According to another aspect of the present invention, there is provided a substrate holding apparatus for holding a semiconductor wafer having a thickness t (μm), Young's modulus E (MPa) and pressing the semiconductor wafer against a polishing surface, comprising: an elastic membrane; an apparatus body for holding the elastic membrane; a plurality of pressure chambers partitioned by a plurality of concentrically circumferential walls of the elastic membrane between the elastic membrane and a lower surface of the apparatus body, the semiconductor wafer being held by a lower surface of the elastic membrane and being pressed against the polishing surface with a fluid pressure by supplying a pressurized fluid to the plurality of pressure chambers; the plurality of concentrically circumferential walls being configured to define a plurality of pressurizing areas for pressing the semiconductor wafer, the plurality of pressurizing areas comprising a central pressurizing area located at a central part of the elastic membrane, an annular edge pressurizing area located at the outermost part of the elastic membrane, and a plurality of intermediate pressurizing areas located between the central pressurizing area and the annular edge pressurizing area; wherein an area width of at least one of the intermediate pressurizing areas is set in a range to allow a polishing rate responsive width not to vary even when the area width is varied; and the area width of the at least one of the intermediate pressurizing areas is set in the range of not less than 2 mm and not more than EWb (mm) defined in the following formula; $EWb=15\times(t/775)^3\times(E/194000)$.

According to the elastic membrane of the present invention, the elastic membrane is used in the substrate holding apparatus of the polishing apparatus for polishing the surface of the substrate, and thus the range of polishing rate distribution (variation range of polishing rate) between a plurality of pressurizing areas defined by the elastic membrane and also in the respective pressurizing areas can be narrowed to enhance the uniformity of the surface, being polished, of the substrate and improve yield.

DETAILED DESCRIPTION OF THE PREFERRED EMBODIMENTS

Embodiments of the present invention will be described below with reference to FIGS. 3 through 15. In the following examples, a semiconductor wafer having a diameter of 300 mm and a thickness of 775±25 μm is used as a substrate. Young's modulus (MPa) of the semiconductor wafer is 194000.

Figure 1:
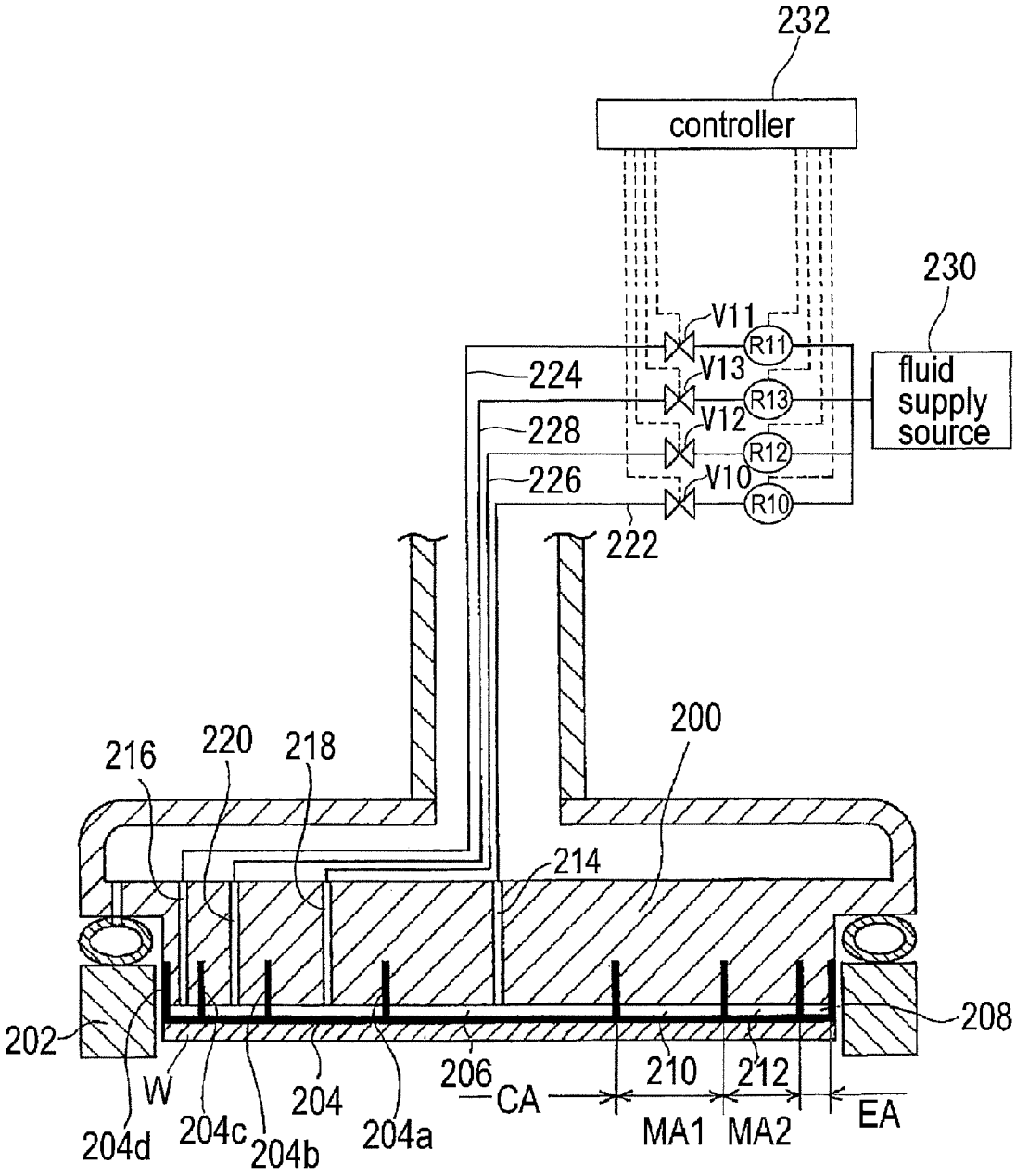
FIG. 1 is a schematic view showing a conventional substrate holding apparatus.
Figure 2:
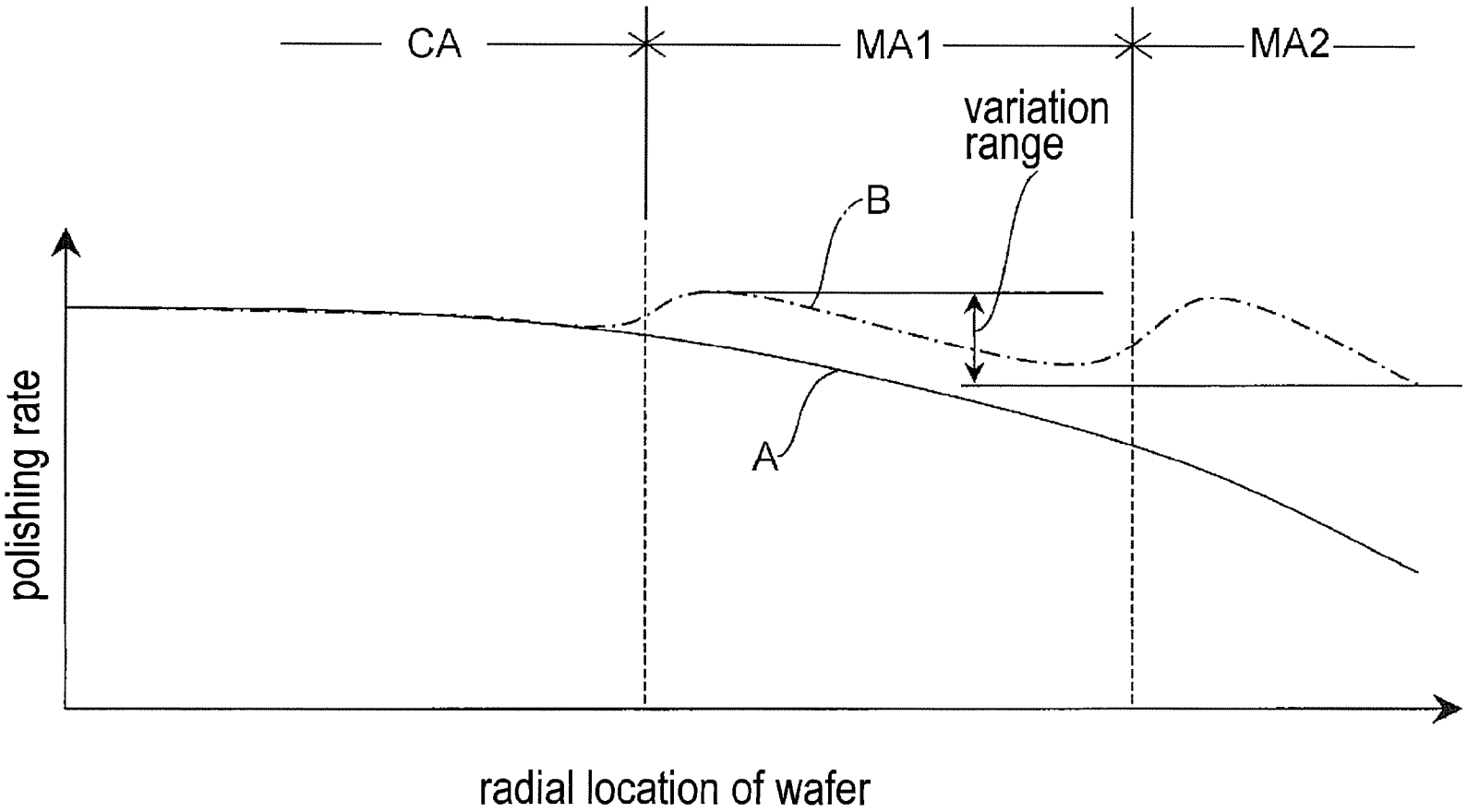
FIG. 2 is a graph showing the relationship between locations along a radial direction of a semiconductor wafer and a polishing rate when the semiconductor wafer is held and polished by the substrate holding apparatus shown in FIG. 1.
Figure 3:
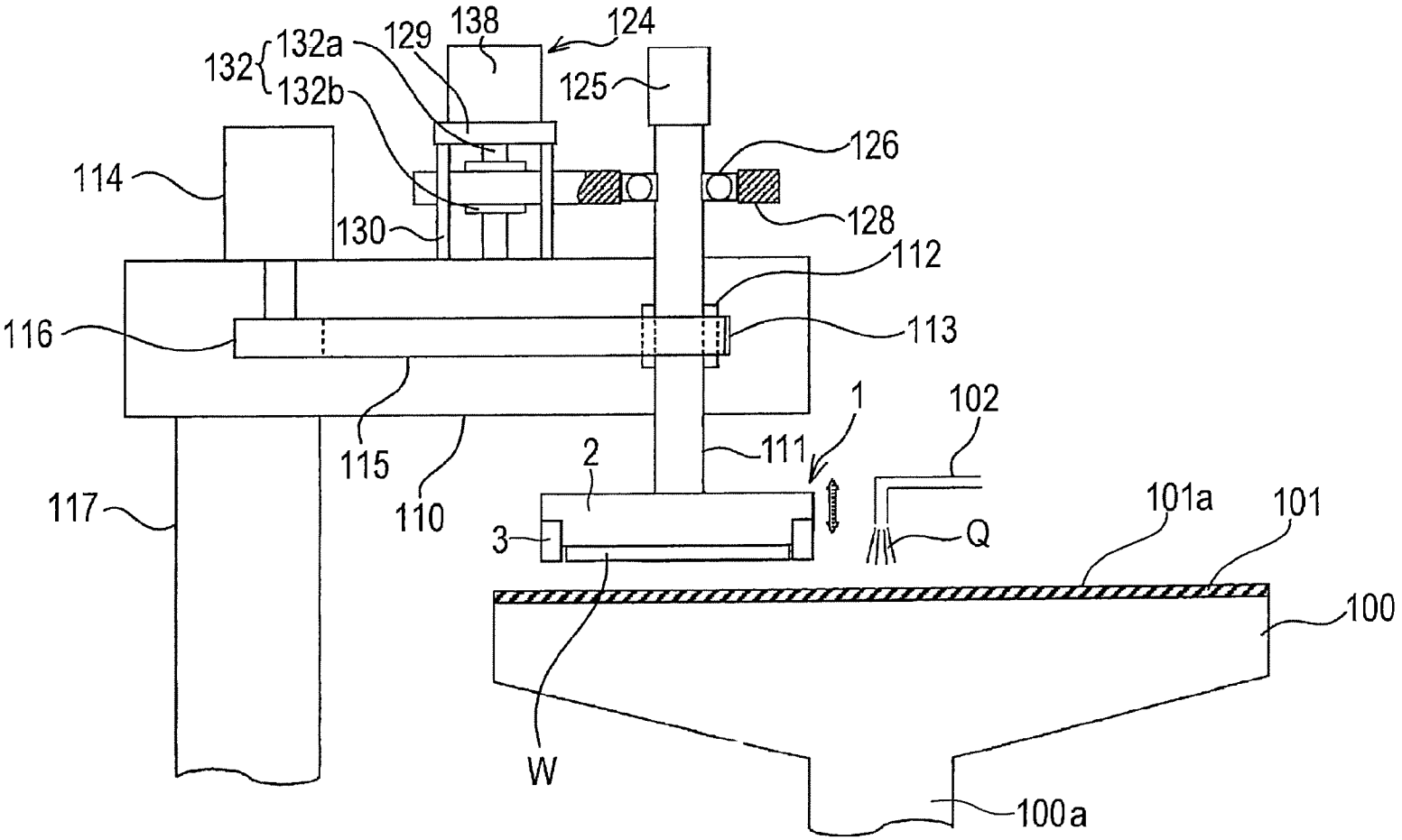
FIG. 3 is a schematic view showing an entire structure of a polishing apparatus having a substrate holding apparatus according to the present invention.

FIG. 3 is a schematic view showing an entire structure of a polishing apparatus having a substrate holding apparatus according to the present invention. As shown in FIG. 3, the polishing apparatus comprises a polishing table 100, and a substrate holding apparatus 1 for holding a semiconductor wafer (substrate) W having a diameter of 300 mm as an object to be polished and pressing the semiconductor wafer against a polishing surface on the polishing table 100. The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface of the polishing pad 101 constitutes a polishing surface 101*a* to polish a semiconductor wafer W. A polishing liquid supply nozzle 102 is provided above the polishing table 100 to supply a polishing liquid Q onto the polishing surface 101*a* of the polishing pad 101 on the polishing table 100.

The substrate holding apparatus 1 is connected to a main shaft 111, which is vertically movable with respect to a polishing head 110 by a vertically moving mechanism 124. By vertical movement of the main shaft 111, the substrate holding apparatus 1 is lifted and lowered as a whole for positioning with respect to the polishing head 110. A rotary joint 125 is mounted on the upper end of the main shaft 111.

The vertically moving mechanism 124 for vertically moving the main shaft 111 and the substrate holding apparatus 1 comprises a bridge 128 on which the main shaft 111 is rotatably supported by a bearing 126, a ball screw 132 mounted on the bridge 128, a support base 129 supported by support posts 130, and an AC servomotor 138 mounted on the support base 129. The support base 129, which supports the AC servomotor 138 thereon, is fixedly mounted on the polishing head 110 by the support posts 130.

The ball screw 132 comprises a screw shaft 132*a* coupled to the AC servomotor 138 and a nut 132*b* threaded over the screw shaft 132*a*. The main shaft 111 is vertically movable in unison with the bridge 128 by the vertically moving mechanism 124. When the AC servomotor 138 is energized, the bridge 128 moves vertically via the ball screw 132, and the main shaft 111 and the substrate holding apparatus 1 move vertically.

The main shaft 111 is connected to a rotary sleeve 112 by a key (not shown). The rotary sleeve 112 has a timing pulley 113 fixedly disposed therearound. A motor 114 having a drive shaft is fixed to the polishing head 110. The timing pulley 113 is operatively coupled to a timing pulley 116 mounted on the drive shaft of the motor 114 by a timing belt 115. When the motor 114 is energized, the timing pulley 116, the timing belt 115, and the timing pulley 113 are rotated to rotate the rotary sleeve 112 and the main shaft 111 in unison with each other, thus rotating the substrate holding apparatus 1. The polishing head 110 is supported on a head shaft 117 rotatably supported on a frame (not shown).

In the polishing apparatus constructed as shown in FIG. 3, the substrate holding apparatus 1 is configured to hold the semiconductor wafer (substrate) W on its lower surface. The polishing head 110 is pivotable (swingable) about the head shaft 117. Thus, the substrate holding apparatus 1, which holds the semiconductor wafer W on its lower surface, is moved between a position at which the substrate holding apparatus 1 receives the semiconductor wafer W and a position above the polishing table 100 by pivotal movement of the polishing head 110. The substrate holding apparatus 1 is lowered to press the semiconductor wafer W against the polishing surface 101*a* of the polishing pad 101. At this time, while the substrate holding apparatus 1 and the polishing table 100 are respectively rotated, a polishing liquid Q is supplied onto the polishing surface 101*a* of the polishing pad 101 by the polishing liquid supply nozzle 102 provided above the polishing table 100. The semiconductor wafer W is brought into sliding contact with the polishing surface 101*a* of the polishing pad 101 in the presence of the polishing liquid Q. Thus, a surface of the semiconductor wafer W is polished.

Next, the substrate holding apparatus 1 according to an embodiment of the present invention which is provided in the polishing apparatus shown in FIG. 3 will be described in detail with reference to FIG. 4.

Figure 4:
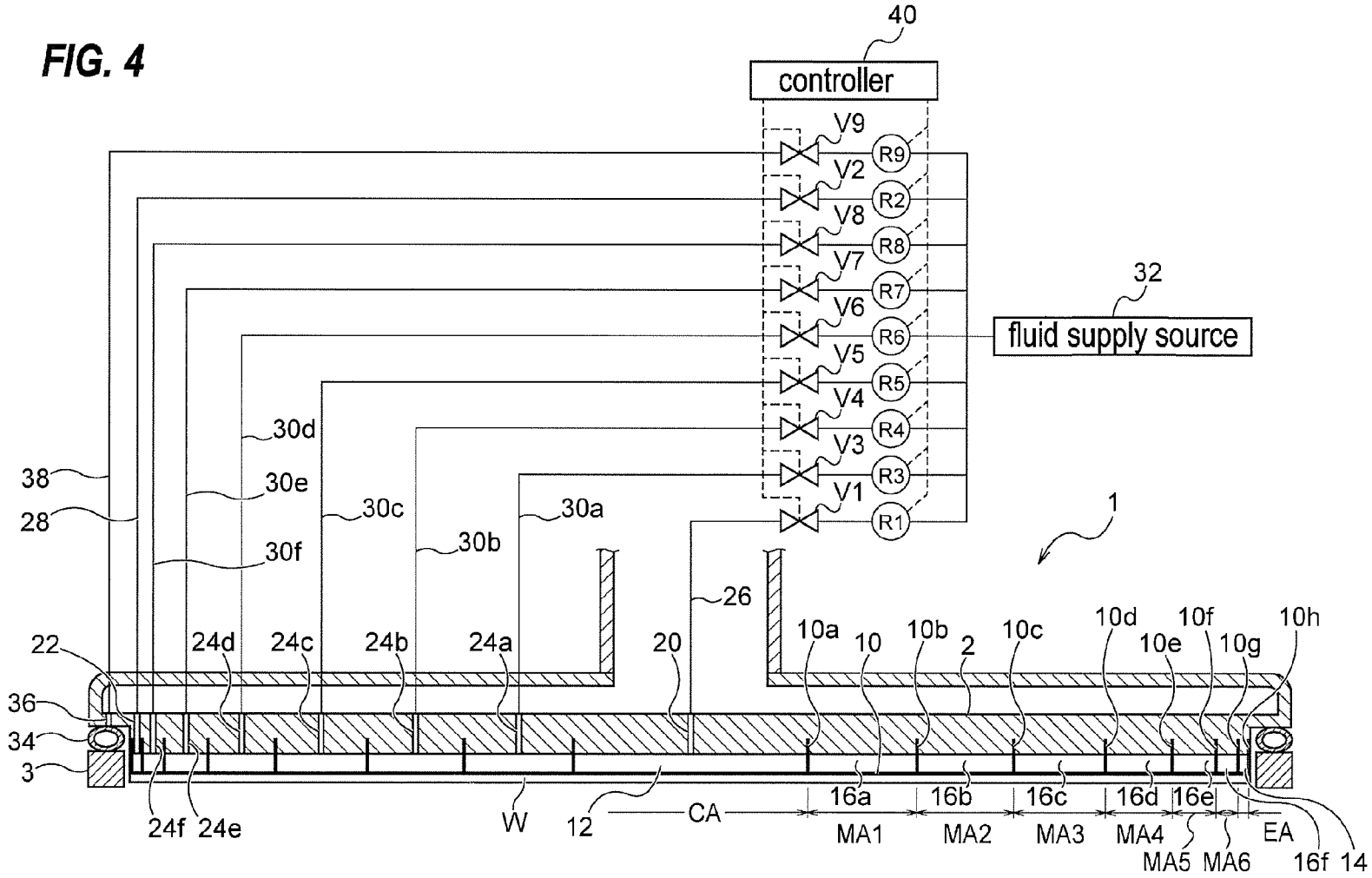
FIG. 4 is a schematic view showing the substrate holding apparatus provided in the polishing apparatus shown in FIG. 3.

As shown in FIG. 4, the substrate holding apparatus 1 basically comprises an apparatus body 2 for pressing the semiconductor wafer W against the polishing surface 101*a*, and a retainer ring 3 for directly pressing the polishing surface 101*a*. An elastic membrane 10 is provided on a lower surface of the apparatus body 2 to cover the lower surface of the apparatus body 2. The elastic membrane 10 has a plurality of (eight in the figure) circumferential walls (first to eighth circumferential walls) 10*a*, 10*b*, 10*c*, 10*d*, 10*e*, 10*f*, 10*g* and 10*h*, which are arranged concentrically and extend upward. By these concentric circumferential walls 10*a* 10*b*, 10*c*, 10*d*, 10*e*, 10*f*, 10*g* and 10*h*, a circular central pressure chamber 12 located at a central part of the elastic membrane 10, an annular edge pressure chamber 14 located at the outermost part of the elastic membrane 10, and six (in this example) annular intermediate pressure chambers (first to sixth intermediate pressure chambers) 16*a*, 16*b*, 16*c*, 16*d*, 16*e* and 16*f* located between the central pressure chamber 12 and the edge pressure chamber 14, are formed between an upper surface of the elastic membrane 10 and the lower surface of the apparatus body 2.

With this configuration, the semiconductor wafer W is held by the substrate holding apparatus 1 in such a state that there are eight divided pressurizing areas, on the elastic membrane 10, comprising a central pressurizing area CA corresponding to the central pressure chamber 12, an edge pressurizing area EA corresponding to the edge pressure chamber 14, and six annular intermediate pressurizing areas (first to sixth intermediate areas) MA1, MA2, MA3, MA4, MA5 and MA6 corresponding respectively to the intermediate pressure chambers 16*a*, 16*b*, 16*c*, 16*d*, 16*e* and 16*f*.

In this example, a radius of the central pressurizing area CA, i.e. a radius of the first circumferential wall 10*a* located at the innermost is set to be 30 mm. The radius of the first circumferential wall 10*a* is a distance from the center of the elastic membrane 10 to the center of the cross-section of a rising portion of the first circumferential wall 10*a*. This holds true for the following respective circumferential walls 10*b*, 10*c*, 10*d*, 10*e*, 10*f*, 10*g* and 10*h*.

An area width of the first intermediate pressurizing area MA1 located at a central side of the elastic membrane 10, i.e. a difference between the radius of the first circumferential wall 10*a* located at the innermost and a radius of the second circumferential wall 10*b* located at the second from the inside, is set to be 30 mm. The area width of the first intermediate pressurizing area MA 1 is a radial area width of the first intermediate pressurizing area MA1. An area width of the second intermediate pressurizing area MA2 located at the second from the central side of the elastic membrane 10, i.e. a difference between the radius of the second circumferential wall 10*b* located at the second from the inside and a radius of the third circumferential wall 10*c* located at the third from the inside, is set to be 25 mm. The area width of the second intermediate pressurizing area MA2 is a radial area width of the second intermediate pressurizing area MA2.

Similarly, an area width of the third intermediate pressurizing area MA3 located at the third from the central side of the elastic membrane 10 is set to be 25 mm, and an area width of the fourth intermediate pressurizing area MA4 located at the fourth from the central side of the elastic membrane 10 is set to be 17 mm. Further, an area width of the fifth intermediate pressurizing area MA5 located at the fifth from the central side of the elastic membrane 10 is set to be 13.5 mm, and an area width of the sixth intermediate pressurizing area MA6 located at the sixth from the central side of the elastic membrane 10 is set to be 4.5 mm. The area widths of the intermediate pressurizing areas MA3, MA4, MA5 and MA6 are radial area widths of the intermediate pressurizing areas MA3, MA4, MA5 and MA6 respectively.

The area width of the fourth intermediate pressurizing area MA4 is arbitrarily set in the range of not less than 2 mm and not more than 20 mm, and the area width of the fifth intermediate pressurizing area MA5 and the area width of the sixth intermediate pressurizing area MA6 are arbitrarily set in the range of not less than 2 mm and not more than 15 mm. Only one of the area widths of the fifth intermediate pressurizing area MA5 and the sixth intermediate pressurizing area MA6 may be arbitrarily set in the range of not less than 2 mm and not more than 15 mm. For example, the area width of the fifth intermediate pressurizing area MA5 may be arbitrarily set in the range of not less than 2 mm and not more than 20 mm and the area width of the sixth intermediate pressurizing area MA6 may be arbitrarily set in the range of not less than 2 mm and not more than 15 mm.

A passage 20 communicating with the central pressure chamber 12, a passage 22 communicating with the edge pressure chamber 14, and passages 24*a*, 24*b*, 24*c*, 24*d*, 24*e* and 24*f* communicating with the intermediate pressure chambers 16*a*, 16*b*, 16*c*, 16*d*, 16*e* and 16*f* respectively, are formed in the apparatus body 2. The respective passages 20, 22, 24*a*, 24*b*, 24*c*, 24*d*, 24*e* and 24*f* are connected via respective passages 26, 28, 30*a*, 30*b*, 30*c*, 30*d*, 30*e* and 30*f* to a fluid supply source 32. Further, opening and closing valves V1, V2, V3, V4, V5, V6, V7 and V8 and pressure regulators R1, R2, R3, R4, R5, R6, R7 and R8 are provided in the respective passages 26, 28, 30*a*, 30*b*, 30*c*, 30*d*, 30*e* and 30*f*.

Further, a retainer chamber 34 is formed immediately above the retainer ring 3, and the retainer chamber 34 is connected via a passage 36 formed in the apparatus body 2 and a passage 38 having an opening and closing valve V9 and a pressure regulator R9 to the fluid supply source 32. The pressure regulators R1, R2, R3, R4, R5, R6, R7, R8 and R9 have pressure adjusting function for adjusting pressures of the pressurized fluid supplied from the fluid supply source 32 to the pressure chambers 12, 14, 16*a*, 16*b*, 16*c*, 16*d*, 16*e*, 16*f* and the retainer chamber 34, respectively. The pressure regulators R1, R2, R3, R4, R5, R6, R7, R8 and R9 and the opening and closing valves V1, V2, V3, V4, V5, V6, V7, V8 and V9 are connected to a controller 40, and operations of the pressure regulators R1, R2, R3, R4, R5, R6, R7, R8 and R9 and the opening and closing valves V1, V2, V3, V4, V5, V6, V7, V8 and V9 are controlled by the controller 40.

According to the substrate holding apparatus 1 configured as shown in FIG. 4, by controlling pressures of the pressurized fluid supplied to the respective pressure chambers 12, 14, 16*a*, 16*b*, 16*c*, 16*d*, 16*e* and 16*f* in such a state that the semiconductor wafer W is held by the substrate holding apparatus 1, the semiconductor wafer W can be pressed against the polishing surface under different pressures at the respective pressurizing areas CA, EA, MA1, MA2, MA3, MA4, MA5 and MA6 on the elastic membrane 10 along a radial direction of the semiconductor wafer W. Thus, in the substrate holding apparatus 1, pressing forces for pressing the semiconductor wafer W against the polishing pad 101 can be adjusted at the respective areas of the semiconductor wafer W corresponding to the respective pressurizing areas CA, EA, MA1, MA2, MA3, MA4, MA5 and MA6 by adjusting pressures of the pressurized fluid supplied to the respective pressure chambers 12, 14, 16*a*, 16*b*, 16*c*, 16*d*, 16*e* and 16*f* defined between the apparatus body 2 and the elastic membrane 10. At the same time, a pressing force for pressing the polishing pad 101 by the retainer ring 3 can be adjusted by controlling pressure of the pressurized fluid supplied to the retainer chamber 34.

The apparatus body 2 is made of resin such as engineering plastics (e.g. PEEK), and the elastic membrane 10 is made of a highly strong and durable rubber material such as ethylene propylene rubber (EPDM), polyurethane rubber, silicone rubber, or the like.

The reason why the area width of the fourth intermediate pressurizing area MA4 is set to be not less than 2 mm and not more than 20 mm, 17.5 mm in this example, and the area widths of the fifth intermediate pressurizing area MA5 and the sixth intermediate pressurizing area MA6 are set to be not less than 2 mm and not more than 15 mm, 13.5 mm in the case of the fifth intermediate pressurizing area MA5 and 4.5 mm in the case of the sixth intermediate pressurizing area MA6 in this example in the substrate holding apparatus 1, will be described below.

Figure 5:
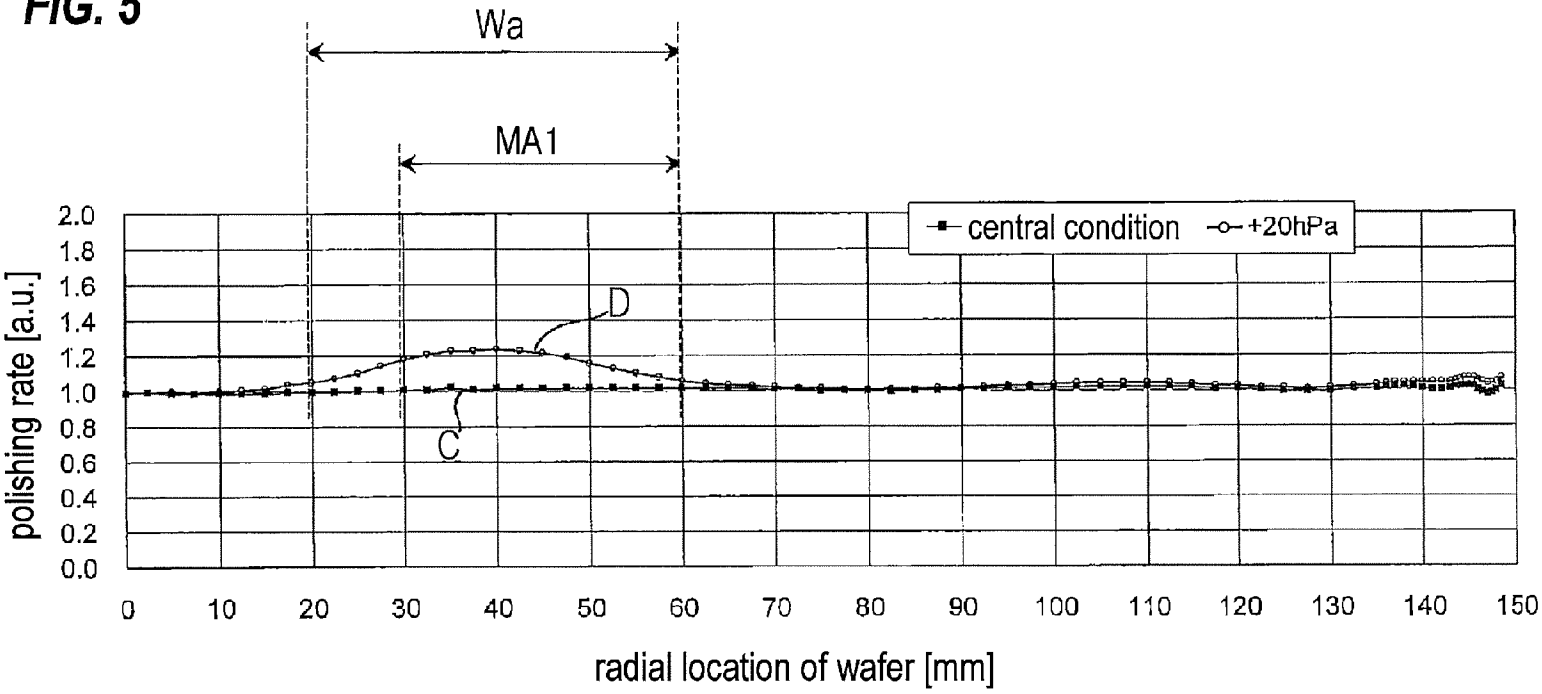
FIG. 5 is a graph showing the relationship between a polishing rate (arbitrary unit) and locations along a radial direction of the semiconductor wafer when the semiconductor wafer is polished by using the polishing apparatus shown in FIG. 3, in the case where pressures of pressurized fluid supplied to respective pressure chambers are substantially equalized and the case where only a pressure of pressurized fluid supplied to one pressure chamber is increased by 20 hPa.

FIG. 5 is a graph showing the relationship between a polishing rate (arbitrary unit) and locations along a radial direction of the semiconductor wafer when the semiconductor wafer having a diameter of 300 mm is practically polished while predetermined pressures of the pressurized fluid are applied to respective pressure chambers 12, 14, 16*a*, 16*b*, 16*c*, 16*d*, 16*e* and 16*f* by using the polishing apparatus shown in FIG. 3. In FIG. 5, the line C shows the relationship between a polishing rate (arbitrary unit) and locations along a radial direction of the semiconductor wafer under the condition (hereinafter referred to as central condition) that pressures of respective pressure chambers are adjusted so that polishing rates at respective pressurizing areas become substantially the same. The line D shows the relationship between a polishing rate (arbitrary unit) and locations along a radial direction of the semiconductor wafer under the condition that only a pressure of the pressurized fluid supplied to the first intermediate pressure chamber 16*a* corresponding to the first intermediate pressurizing area MA1 is increased so as to be higher by 20 hPa than the pressure of the central condition.

From FIG. 5, it is understood that when, for example, only the pressure of the pressurized fluid supplied to the first intermediate pressure chamber 16*a* corresponding to the first intermediate pressurizing area MA1 is increased so as to be higher by 20 hPa than the pressure of the central condition, this effect extends over a polishing rate responsive width Wa which is wider than the first intermediate pressurizing area MA1.

Figure 6:
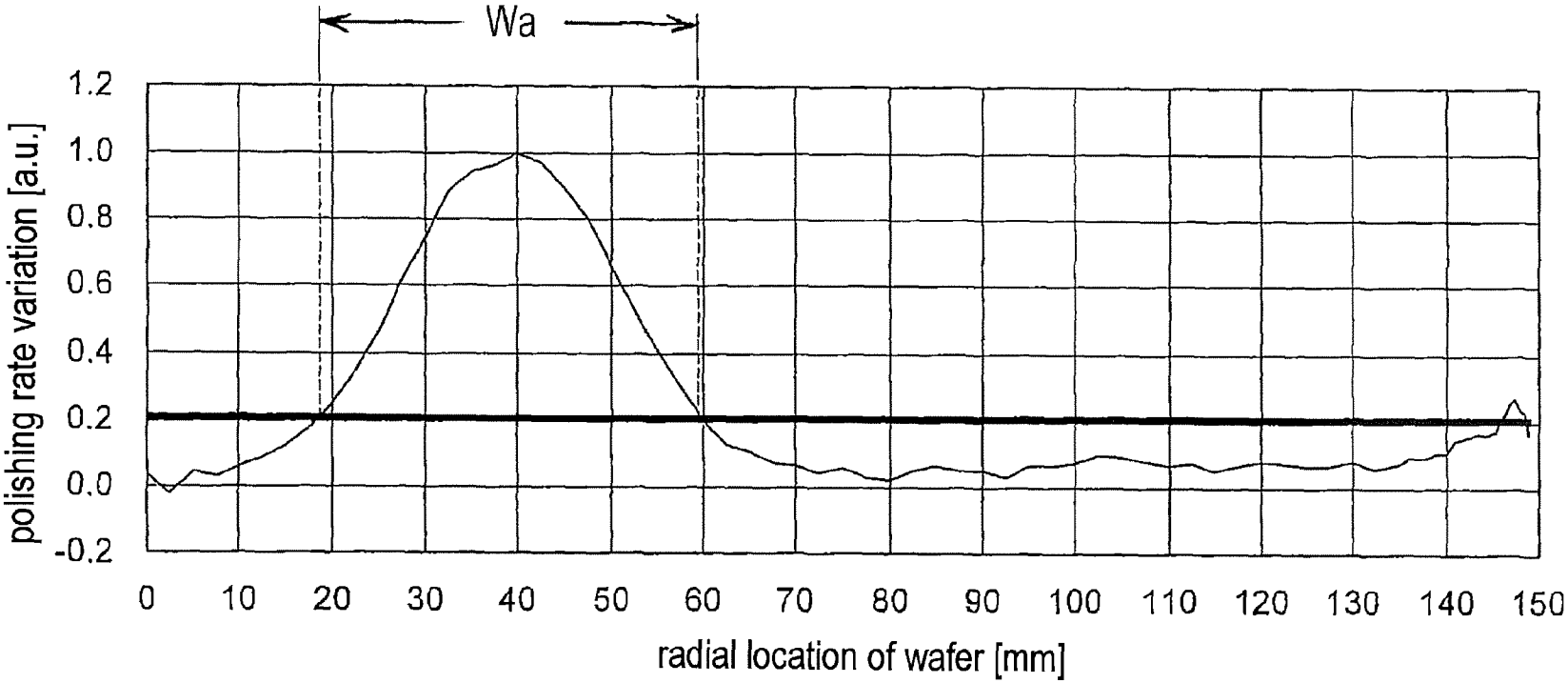
FIG. 6 is a graph for explanation of a definition of a polishing rate responsive width of a pressurizing area.

FIG. 6 is a graph showing differences, as polishing rate variation (arbitrary unit), obtained by subtracting a polishing rate indicated by line C from a polishing rate indicated by line D in FIG. 5, a maximum value of the polishing rate variation being defined as 1 to be a standard. Specifically, the polishing rate variation in FIG. 6 shows an amount of change in the polishing rate in the case where a predetermined pressure is changed from a pressure of the above central condition in a certain pressurizing area. The polishing rate variation when a predetermined pressure is changed from a certain pressure in a certain pressurizing area is calculated, and a radial area of the semiconductor wafer in which the polishing rate variation is not less than 20% and not more than 100% with respect to the maximum polishing rate variation to be a standard is defined as a polishing rate responsive width.

In FIGS. 5 and 6, the polishing rate responsive width is determined from the polishing results when the pressure is increased from the central condition. However, the polishing rate responsive width may be determined from the polishing results when the pressure is lowered from the central condition.

When the maximum polishing rate variation in the first intermediate pressurizing area MA1 is defined as 1 to be a standard and the polishing rate variation is not more than 20% of the maximum polishing rate variation (not more than 0.2 in FIG. 6), it is considered that the effect of this polishing rate variation on a polishing profile is suppressed within a tolerance. Therefore, a radial area of the semiconductor wafer in which the polishing rate variation is not less than 20% and not more than 100% (not less than 0.2 and not more than 1.0 in FIG. 6) with respect to the maximum polishing rate variation, i.e. 1 as the standard in the first intermediate pressurizing area MA1 is defined as a polishing rate responsive width. In the case of FIG. 6, the polishing rate responsive width Wa of the first intermediate pressurizing area MA1 is 41 mm.

Similarly, the polishing rate responsive widths of other intermediate pressurizing areas MA2, MA3, MA4, MA5 and MA6 are measured and the measured values are as follows: The polishing rate responsive widths are 35 mm in the case where only a pressure of the pressurized fluid supplied to the second intermediate pressure chamber 16*b* corresponding to the second intermediate pressurizing area MA2 is increased so as to be higher by 20 hPa than the central condition, 37 mm in the case where only a pressure of the pressurized fluid supplied to the third intermediate pressure chamber 16*c* corresponding to the third intermediate pressurizing area MA3 is increased so as to be higher by 20 hPa than the central condition, 26 mm in the case where only a pressure of the pressurized fluid supplied to the fourth intermediate pressure chamber 16*d* corresponding to the fourth intermediate pressurizing area MA4 is increased so as to be higher by 20 hPa than the central condition, 27 mm in the case where only a pressure of the pressurized fluid supplied to the fifth intermediate pressure chamber 16*e* corresponding to the fifth intermediate pressurizing area MA5 is increased so as to be higher by 20 hPa than the central condition, and 25 mm in the case where only a pressure of the pressurized fluid supplied to the sixth intermediate pressure chamber 16*f* corresponding to the sixth intermediate pressurizing area MA6 is increased so as to be higher by 20 hPa than the central condition.

The relationship between the respective area widths of the respective intermediate pressurizing areas MA1, MA2, MA3, MA4, MA5 and MA6 and the polishing rate responsive widths obtained as described above, is shown in TABLE 1.

TABLE 1

| | Area width [mm] | | | | | |
|---|---|---|---|---|---|---|
| | 30 | 25 | 25 | 17 | 13.5 | 4.5 |
| Polishing rate responsive width [mm] | 41 | 35 | 37 | 26 | 27 | 25 |

Figure 7:
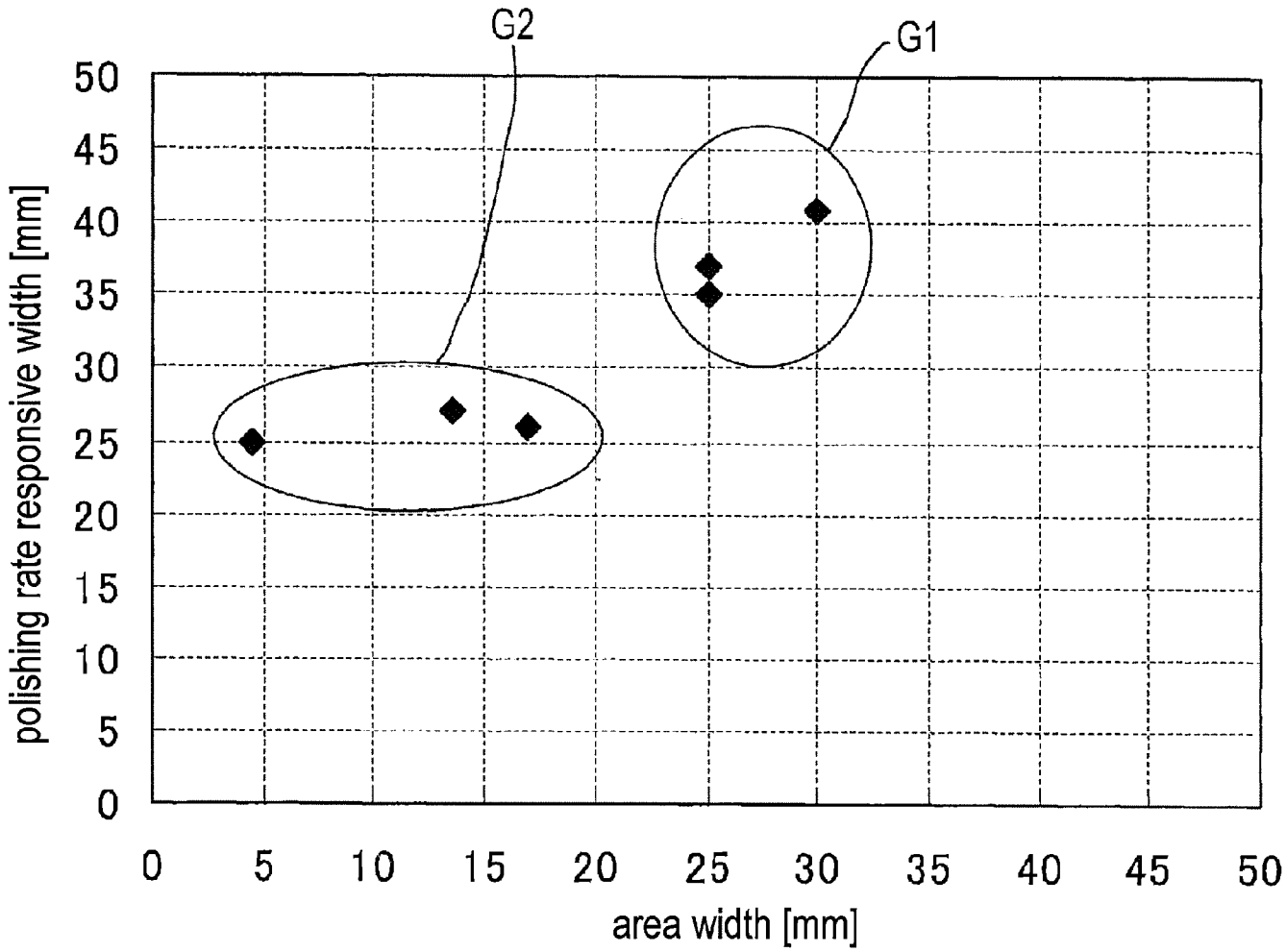
FIG. 7 is a graph showing the relationship between area widths of the pressurizing areas and the polishing rate responsive widths.

FIG. 7, which is drawn based on TABLE 1, shows the relationship between the area widths of the intermediate pressurizing areas and the polishing rate responsive widths. From FIG. 7, it is understood that when the area width of the pressurizing area is not less than 25 mm (group G1), the polishing rate responsive widths are such values as to add approximately 10 mm to the respective area widths, and that even when the area width of the pressurizing area is smaller than 25 mm (group G2), the minimum value of the polishing rate responsive widths is approximately 25 mm. In group G2, even when the area width of the intermediate pressurizing area varies (decreases) among 17 mm, 13.5 mm and 4.5 mm, the polishing rate responsive widths are 26 mm, 27 mm and 25 mm, respectively, and thus nearly-unchanged. Thus, it is considered that the polishing rate responsive width does not change even when the area width of the intermediate pressurizing area is not more than 15 mm.

Figure 8:
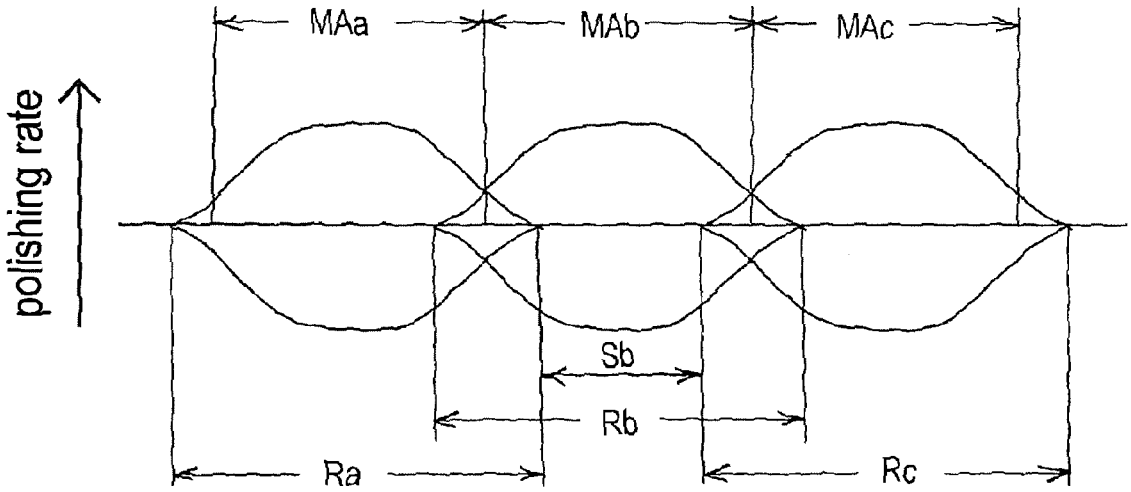
FIG. 8 is a view showing the relationship between intermediate pressurizing areas and polishing rate responsive widths corresponding to the intermediate pressurizing areas, in the case where three intermediate pressurizing areas having relatively wide area widths are adjacent to each other.

FIG. 8 shows the relationship between intermediate pressurizing areas MAa, MAb, MAc and polishing rate responsive widths Ra, Rb, Rc corresponding to the intermediate pressurizing areas MAa, MAb, MAc, in the case where the three intermediate pressurizing areas MAa, MAb, MAc have relatively wide area widths and are adjacent to each other. In FIG. 8, three convex solid lines above a horizontal line indicate respective polishing rates in the case where pressures of the respective areas are higher than those of the central condition, and three concave solid lines below the horizontal line indicate respective polishing rates in the case where pressures of the respective areas are lower than those of the central condition. In this case, in the central area of the intermediate pressurizing area MAb located in the middle, there is an area Sb which is not affected by the polishing rate responsive widths Ra and Rc corresponding to other intermediate pressurizing areas MAa and MAc. The inclination of the polishing rate of the area of the semiconductor wafer corresponding to the area Sb cannot be corrected even when pressures applied to the intermediate pressurizing areas MAa and MAc are changed.

Figure 9:
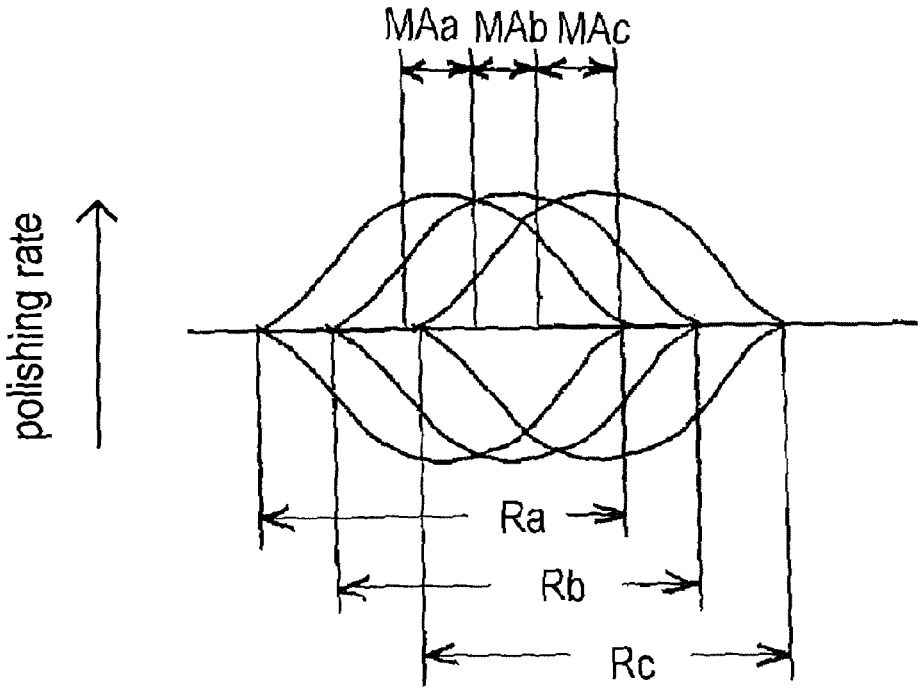
FIG. 9 is a view showing the relationship between intermediate pressurizing areas and polishing rate responsive widths corresponding to the intermediate pressurizing areas, in the case where three intermediate pressurizing areas having relatively narrow area widths are adjacent to each other.

FIG. 9 shows the relationship between intermediate pressurizing areas MAa, MAb, MAc and polishing rate responsive widths Ra, Rb, Rc corresponding to the intermediate pressurizing areas MAa, MAb, MAc, in the case where the three intermediate pressurizing areas MAa, MAb, MAc have relatively small area widths and are adjacent to each other. In FIG. 9, three convex solid lines above a horizontal line indicate respective polishing rates in the case where pressures of the respective areas are higher than those of the central condition, and three concave solid lines below the horizontal line indicate respective polishing rates in the case where pressures of the respective areas are lower than those of the central condition. In this case, the intermediate pressurizing area MAb located in the middle is affected by the polishing rate responsive widths Ra and Rc corresponding to other two intermediate pressurizing areas MAa and MAc. The inclination of the polishing rate of the area of the semiconductor wafer corresponding to the intermediate pressurizing area MAb can be corrected by changing pressures of the intermediate pressurizing areas MAa and MAc. Particularly, the intermediate pressurizing area is preferably divided into small areas in the vicinity of the edge of the semiconductor wafer.

Figure 10:
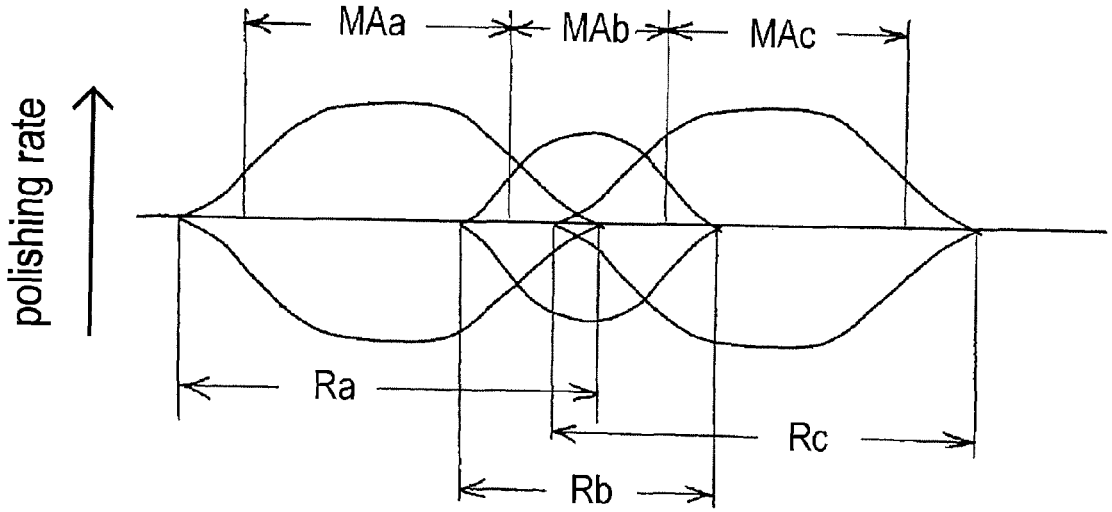
FIG. 10 is a view showing the relationship between intermediate pressurizing areas and polishing rate responsive widths corresponding to the intermediate pressurizing areas, in the case where an intermediate pressurizing area having a relatively narrow area width is located between two adjacent intermediate pressurizing areas having relatively wide area widths.

FIG. 10 shows the relationship between intermediate pressurizing areas MAa, MAb, MAc and polishing rate responsive widths Ra, Rb, Rc corresponding to the intermediate pressurizing areas MAa, MAb, MAc, in the case where an intermediate pressurizing area MAb has a relatively narrow area width and is located between the two adjacent intermediate pressurizing areas MAa, MAc which have relatively wide area widths. In FIG. 10, three convex solid lines above a horizontal line indicate respective polishing rates in the case where pressures of the respective areas are higher than those of the central condition, and three concave solid lines below the horizontal line indicate respective polishing rates in the case where pressures of the respective areas are lower than those of the central condition. In this case, the intermediate pressurizing area MAb located in the middle and having a relatively narrow area width is affected by the polishing rate responsive widths Ra and Rc corresponding to other two intermediate pressurizing areas MAa and MAc. The inclination of the polishing rate of the area of the semiconductor wafer corresponding to the intermediate pressurizing area MAb can be corrected by changing pressures of the intermediate pressurizing areas MAa and MAc. Thus, fine adjustment of polishing profile can be achieved by providing the intermediate pressurizing area MAb having a relatively narrow area width between the intermediate pressurizing areas MAa and MAc having relatively wide area widths.

Figure 11:
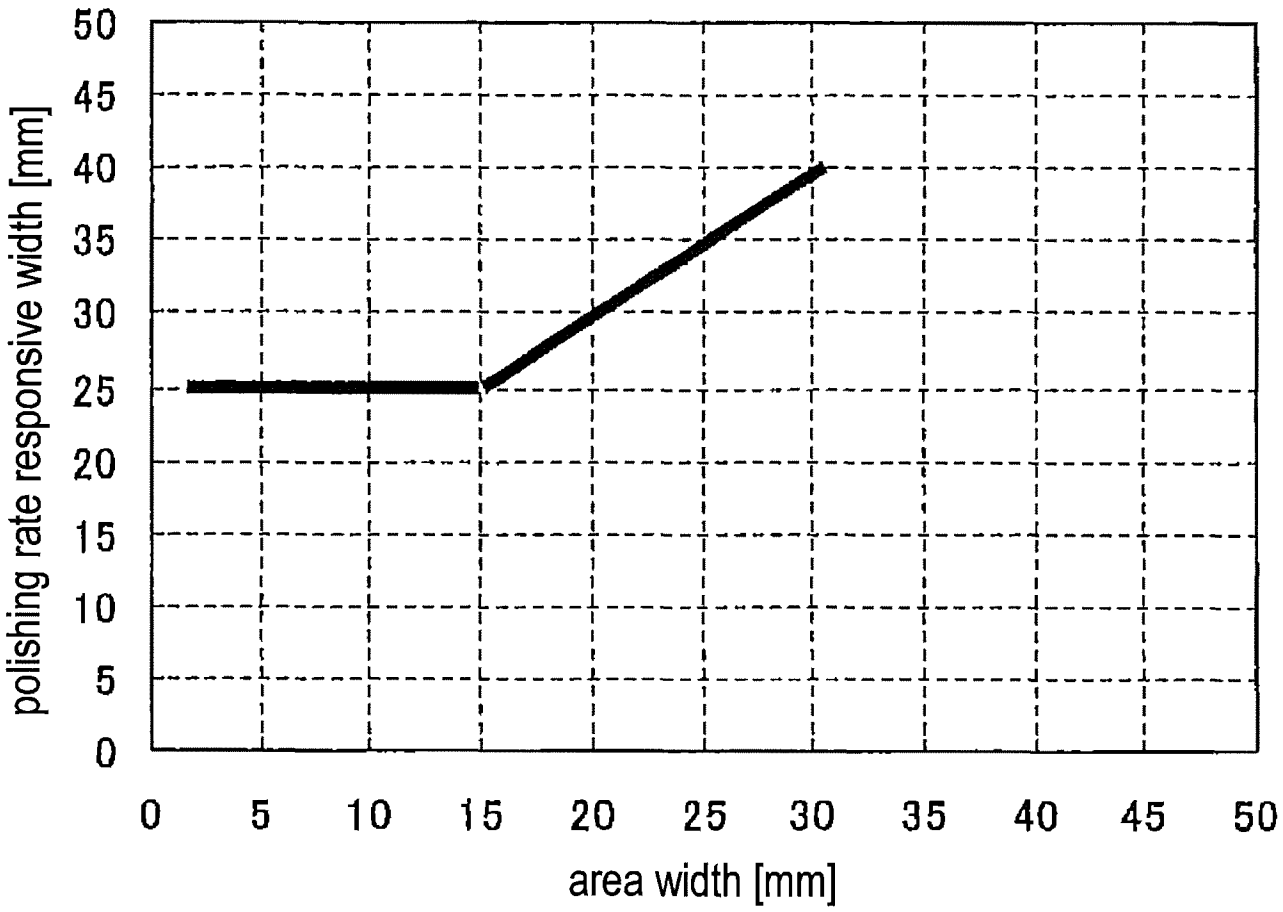
FIG. 11 is a graph showing the relationship between the area widths of the pressurizing areas and the polishing rate responsive widths.
Figure 12:
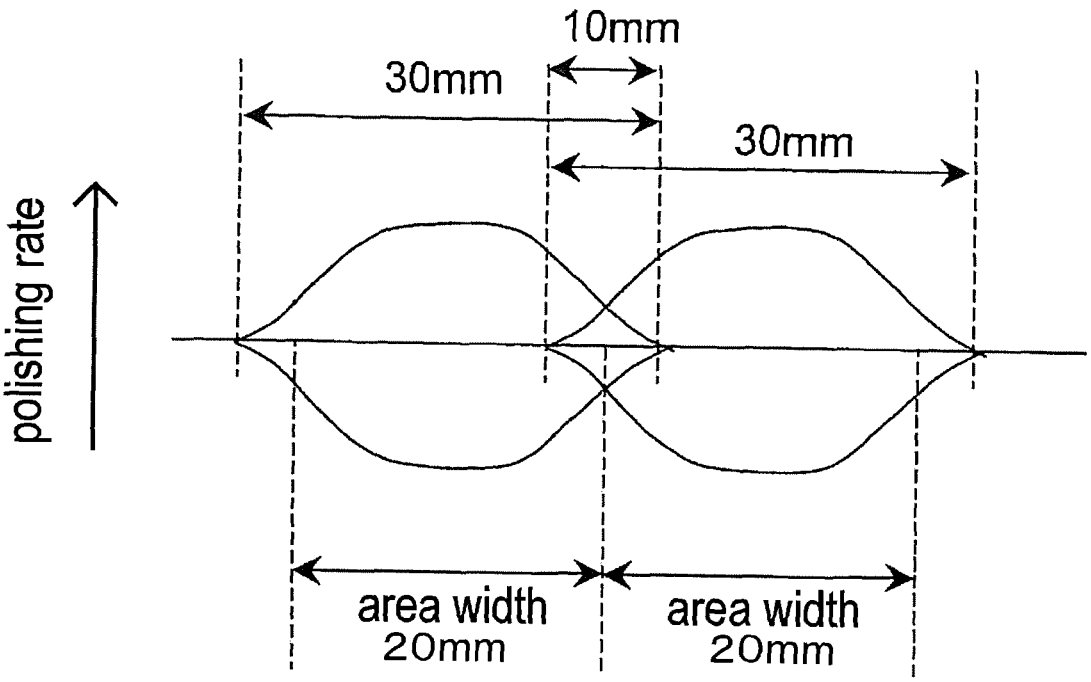
FIG. 12 is a view for explanation of an overlap ratio of polishing rate response in the case where intermediate pressurizing areas, whose area widths are 20 mm and polishing rate responsive widths are 30 mm, are adjacent to each other.

FIG. 11, which models FIG. 7, shows the relationship between the area widths of the intermediate pressurizing areas and the polishing rate responsive widths. In FIG. 11, the polishing rate responsive width of the intermediate pressurizing area having an area width of 20 mm is 30 mm. In the case where the intermediate pressurizing areas, whose area widths are 20 mm and polishing rate responsive widths are 30 mm, are adjacent to each other, the ratio at which the polishing rate responsive widths overlap each other (overlap ratio of polishing rate response) is approximately 33 (=10/30) (%), as shown in FIG. 12. In FIG. 12, two convex solid lines above a horizontal line indicate respective polishing rates in the case where pressures of the respective areas are higher than those of the central condition, and two concave solid lines below the horizontal line indicate respective polishing rates in the case where pressures of the respective areas are lower than those of the central condition.

Figure 13:
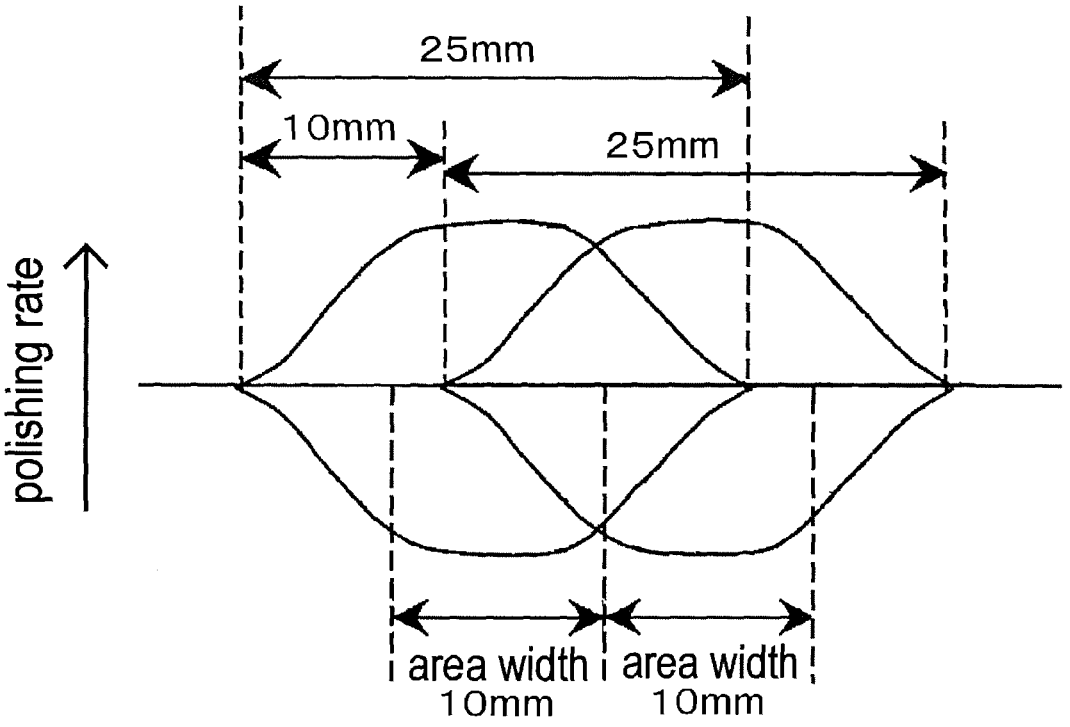
FIG. 13 is a view for explanation of an overlap ratio of polishing rate response in the case where intermediate pressurizing areas, whose area widths are 10 mm and polishing rate responsive widths are 25 mm, are adjacent to each other.

Further, in FIG. 11, the polishing rate responsive width of the intermediate pressurizing area having an area width of 10 mm is 25 mm. In the case where the intermediate pressurizing areas, whose area widths are 10 mm and polishing rate responsive widths are 25 mm, are adjacent to each other, the ratio at which the polishing rate responsive widths overlap each other (overlap ratio of polishing rate response) is 60 (=15/25) (%), as shown in FIG. 13. In FIG. 13, two convex solid lines above a horizontal line indicate respective polishing rates in the case where pressures of the respective areas are higher than those of the central condition, and two concave solid lines below the horizontal line indicate respective polishing rates in the case where pressures of the respective areas are lower than those of the central condition.

Figure 14:
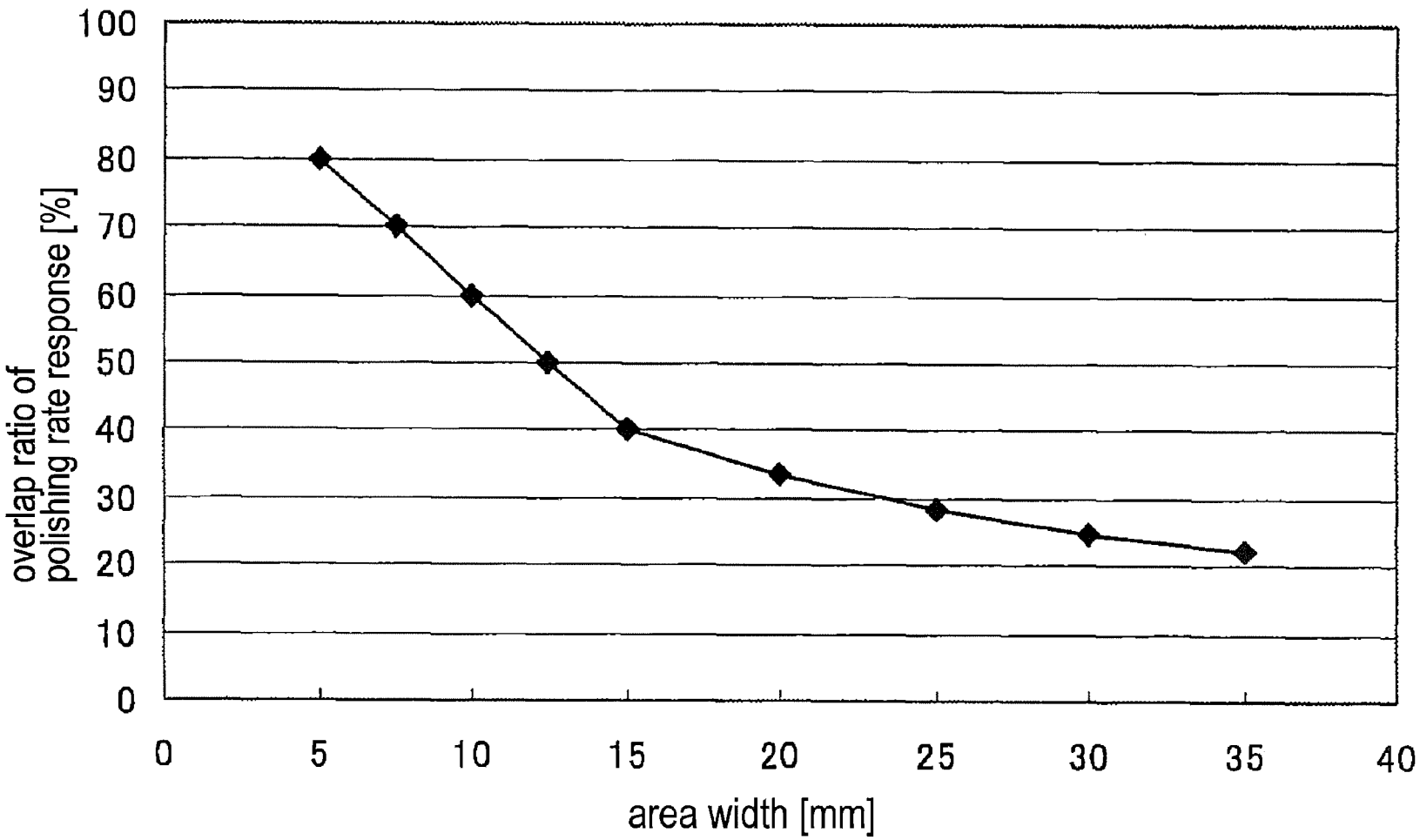
FIG. 14 is a graph showing the relationship between the area widths of the pressurizing areas and the overlap ratios of polishing rate response.

FIG. 14, which is drawn based on FIG. 11, shows the relationship between the area widths of the intermediate pressurizing areas and the overlap ratios of polishing rate response. From FIG. 14, it is understood that the polishing rate responsive width becomes no smaller than 25 mm in the intermediate pressurizing area having the area width of not more than 15 mm, and hence the ratio at which the polishing rate responsive widths overlap each other (overlap ratio of polishing rate response) becomes larger, and thus fine adjustment of polishing profile can be achieved in the intermediate pressurizing area having the area width of not more than 15 mm. Further, it is understood that the ratio at which the polishing rate responsive widths overlap each other (overlap ratio of polishing rate response) is approximately 33% or higher and still relatively large also in the intermediate pressurizing area having the area width of not more than 20 mm, and thus fine adjustment of polishing profile can be achieved in the intermediate pressurizing area having the area width of not more than 20 mm. From FIG. 14, in the case where the area width is not more than 15 mm, the ratio at which the polishing rate responsive widths overlap each other (overlap ratio of polishing rate response) is greatly changed, and thus the area width of not more than 15 mm is taken as one of the area width set standards. Further, the ratio at which the polishing rate responsive widths overlap each other (overlap ratio of polishing rate response) becomes relatively large also in the area width of not more than 20 mm obtained by adding a certain range to the area width of not more than 15 mm, and thus the area width of not more than 20 mm is also taken as one of the area width set standards.

Thus, in this example, in consideration of the thickness of the circumferential wall (approximately 1 mm), the area widths of the fifth intermediate pressurizing area MA5 and the sixth intermediate pressurizing area MA6, which are located in the vicinity of the edge of the substrate such as a semiconductor wafer and need fine adjustment of polishing profile most, are set to be not less than 2 mm and not more than 15 mm. Specifically, the area width of the fifth intermediate pressurizing area MA5 is set to be 13.5 mm, and the area width of the sixth intermediate pressurizing area MA6 is set to be 4.5 mm. Further, the area width of the fourth intermediate pressurizing area MA4, which needs fine adjustment of polishing profile next to the fifth intermediate pressurizing area MA5 and the sixth intermediate pressurizing area MA6, is set to be not less than 2 mm and not more than 20 mm, specifically 17.5 mm. The reason why the area width is set to be not less than 2 mm is that the thickness of the circumferential wall (approximately 1 mm) and the passage of the pressurized fluid (lower limit is approximately 1 mm) are considered.

Figure 15:
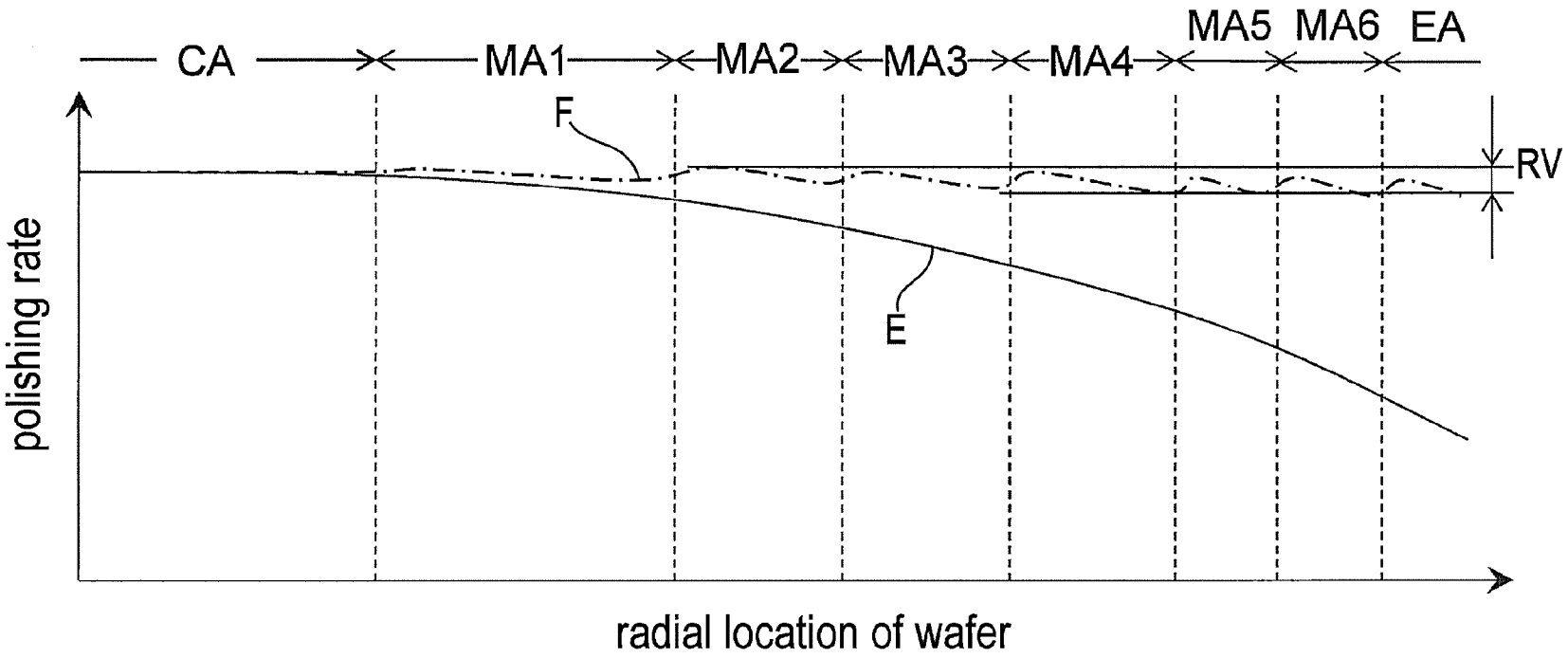
FIG. 15 is a graph showing the relationship between radial locations of the semiconductor wafer and a polishing rate when the semiconductor wafer having a diameter of 300 mm is polished by using the polishing apparatus shown in FIG. 3.

FIG. 15 shows the relationship between radial locations of the semiconductor wafer and a polishing rate when the semiconductor wafer having a diameter of 300 mm is polished by using the polishing apparatus shown in FIG. 3. In FIG. 15, a solid line E indicates the case where the semiconductor wafer is polished while pressures of pressurized fluid supplied to the respective pressure chambers 12, 14, 16*a*, 16*b*, 16*c*, 16*d*, 16*e* and 16*f* are equalized. A dotted-dashed line F indicates the case where the semiconductor wafer is polished while pressures of pressurized fluid supplied to the intermediate pressure chambers 16*a*, 16*b*, 16*c*, 16*d*, 16*e* and 16*f* are adjusted. In FIG. 15, with respect to radial locations of the semiconductor wafer, areas CA, MA1, MA2, MA3, MA4, MA5, MA6 and EA along a radial direction of the semiconductor wafer, correspond to the respective pressurizing areas CA, MA1, MA2, MA3, MA4, MA5, MA6 and EA shown in FIG. 4.

From FIG. 15, it is understood that the polishing apparatus shown in FIG. 3 is used, and by adjusting pressures of pressurized fluid supplied to respective pressure chambers 12, 14, 16*a*, 16*b*, 16*c*, 16*d*, 16*e* and 16*f* and by using the elastic membrane which has adjusted radial area widths of respective pressurizing areas for pressing the semiconductor wafer, the range of polishing rate distribution (variation range of polishing rate) RV between a plurality of pressurizing areas of the semiconductor wafer and also in the respective pressurizing areas can be narrowed to enhance uniformity of the surface, being polished, of the semiconductor wafer and improve yield.

Next, the case where a semiconductor wafer having a diameter of 450 mm is polished will be described. The standard thickness of the semiconductor wafer having a diameter of 450 mm is assumed to be 925±25 μm.

Then, the flexural rigidity D of a circular disc is expressed in the following formula.

$$D=Eh^3/12(1-\nu^2)$$

Here, E is Young's modulus, h is a disc thickness, and ν is Poisson's ratio. The flexural rigidity D of the circular disc is proportional to the cube of the disc thickness h.

In the case of the semiconductor wafer having a diameter of 300 mm, the reason why the polishing rate responsive width does not become a certain value or less (25 mm or less) even when the area width of the intermediate pressurizing area is narrowed, is due to the rigidity of the semiconductor wafer. The semiconductor wafer having a diameter of 450 mm has a rigidity of cube of (925/775), i.e. approximately 1.7 times that of the semiconductor wafer having a diameter of 300 mm.

Therefore, the area widths of 20 mm, 15 mm in the case of the semiconductor wafer having a diameter of 300 mm, are equivalent to 20×1.7=34 mm, 15×1.7=26 mm, respectively in the case of the semiconductor wafer having a diameter of 450 mm.

Accordingly, when the semiconductor wafer having a diameter of 450 mm is polished by using the polishing apparatus shown in FIG. 3, the area width of the fourth intermediate pressurizing area MA4 corresponding to the fourth intermediate pressure chamber 16*d* is arbitrarily set in the range of not less than 2 mm and not more than 34 mm, and the area widths of the fifth intermediate pressurizing area MA5 and the sixth intermediate pressurizing area MA6 corresponding respectively to the fifth intermediate pressure chamber 16*e* and the sixth intermediate pressure chamber 16*f* are arbitrarily set in the range of not less than 2 mm and not more than 26 mm.

In more general description, when an area width of an intermediate pressurizing area in the case of a semiconductor wafer having a diameter of 300 mm is EWa, an area width EWb of an intermediate pressurizing area in the case of a semiconductor wafer having a thickness t (μm), Young's modulus E (MPa) is expressed as $EWb=EWa\times(t/775)^3\times(E/194000)$.

Although certain preferred embodiments of the present invention have been shown and described in detail, it should be understood that various changes and modifications may be made without departing from the scope of the appended claims.

What is claimed is:

1. A substrate holding apparatus for holding a substrate to be polished and pressing the substrate against a polishing surface, comprising:

an elastic membrane;

an apparatus body for holding said elastic membrane;

a plurality of annular pressure chambers concentrically arranged and partitioned by a plurality of concentrically circumferential walls of said elastic membrane between said elastic membrane and a lower surface of said apparatus body, the substrate being held by a lower surface of said elastic membrane and being pressed against the polishing surface with a fluid pressure by supplying a pressurized fluid to said plurality of pressure chambers;

a first pressure regulator configured to adjust a first pressure of the pressurized fluid supplied to a first pressure chamber of the plurality of pressure chambers;

a second pressure regulator configured to adjust a second pressure of the pressurized fluid supplied to a second pressure chamber adjacent to the first pressure chamber; and a controller in communication with the first pressure regulator and the second regulator, the controller configured to control the first pressure regulator and the second pressure regulator based at least in part on:

a first polishing rate responsive width in an area of a radial direction of the membrane obtained in advance when the pressurized fluid is supplied to the first pressure chamber at a pressure different than adjacent chambers to press a test substrate against the polishing surface, wherein the first polishing rate responsive width corresponds to a radial area of the substrate in which a polishing rate is affected by the pressurized fluid supplied to the first pressure chamber, and the first polishing rate responsive width is larger than a distance between the locations where two circumferential walls for forming the first pressure chamber join the membrane; and a second polishing rate responsive width in an area of a radial direction of the membrane obtained in advance when the pressurized fluid is supplied to the second pressure chamber at a pressure different than adjacent chambers to press the test substrate against the polishing surface, wherein the second polishing rate responsive width corresponds to a radial area of the substrate in which a polishing rate is affected by the pressurized fluid supplied to the second pressure chamber, and the second polishing rate responsive width is larger than a distance between the two circumferential walls for forming the second pressure chamber;

wherein the controller causes the first pressure regulator and the second pressure regulator to adjust a variable range of a polishing rate distribution in an area of the substrate corresponding to the first pressure chamber, the adjustment based at least in part on the first pressure of the pressurized fluid, the second pressure of the pressurized fluid, and a determined overlap ratio, the determined overlap ratio determined based on a ratio at which the first polishing rate responsive width and the second polishing rate responsive width overlap each other for the first and second pressure chamber.

2. The substrate holding apparatus according to claim 1, further comprising a third pressure regulator configured to adjust a third pressure of the pressurized fluid supplied to a third pressure chamber adjacent to the first pressure chamber at the other side of the second pressure chamber;

wherein the controller is further configured to control the third pressure regulator based at least in part on a third polishing rate responsive width in an area of a radial direction of the substrate obtained in advance when the pressurized fluid is supplied to the third pressure chamber to press the substrate against the polishing surface, wherein the controller further causes the third pressure regulator to adjust the variable range of the polishing rate distribution in the area of the substrate corresponding to the first pressure chamber, the adjustment further based at least in part on the third pressure of the pressurized fluid and an overlap ratio at which the first polishing rate responsive width and the third polishing rate responsive width overlap each other.

3. The substrate holding apparatus according to claim 2, wherein the overlap ratio at which the first polishing rate responsive width and the third polishing rate responsive width overlap each other is 33% or higher.

4. The substrate holding apparatus according to claim 1, wherein said plurality of concentrically circumferential walls are configured to define a plurality of pressurizing areas for pressing the substrate, said plurality of pressurizing areas comprising a central pressurizing area located at a central part of said elastic membrane, an annular edge pressurizing area located at the outermost part of said elastic membrane, and a plurality of intermediate pressurizing areas located between said central pressurizing area and said annular edge pressurizing area, wherein an area width of at least one of said intermediate pressurizing areas is set in a range to allow a polishing rate responsive width not to vary even when the area width is varied.

5. The substrate holding apparatus according to claim 4, wherein said polishing rate responsive width corresponds to a radial area of the substrate determined in each of said plurality of intermediate pressurizing areas; and an absolute value of variation between a polishing rate when the substrate is polished under certain pressure condition and a polishing rate when the substrate is polished under pressure condition changed by a predetermined pressure from said certain pressure condition in each of said intermediate pressurizing areas is calculated, and the radial area of the substrate in which said absolute value of the polishing rate variation is not less than 20% and not more than 100% with respect to a maximum absolute value of the polishing rate variation in each of said intermediate pressurizing areas is defined as said polishing rate responsive width.

6. The substrate holding apparatus according to claim 4, wherein said at least one of said intermediate pressurizing areas whose area width is set in the range to allow said polishing rate responsive width not to vary even when the area width is varied, comprises at least two of said plurality of intermediate pressurizing areas which are adjacent to each other.

7. The substrate holding apparatus according to claim 1, wherein the overlap ratio at which the first polishing rate responsive width and the second polishing rate responsive width overlap each other is 33% or higher.

8. The substrate holding apparatus according to claim 1, wherein the first pressure chamber is a pressure chamber adjacent to a radially outermost pressure chamber.

9. The substrate holding apparatus according to claim 1, wherein the first pressure chamber is a pressure chamber corresponding to the vicinity of the edge of the substrate.

10. The substrate holding apparatus according to claim 1, wherein the polishing rate distribution in the area of the substrate corresponding to the first pressure chamber is a polishing rate distribution in a radial direction of the substrate.

11. The substrate holding apparatus according to claim 1, wherein the variable ranges of the polishing rate distributions in the areas of the substrate corresponding to the plurality of pressure chambers are adjusted by a plurality of pressures of the pressurized fluid supplied to the plurality of pressure chambers including the first pressure chamber and the second pressure chamber, and the overlap ratio at which the two polishing rate responsive widths overlap each other, thereby adjusting uniformity of the surface, being polished, of the substrate.

12. The substrate holding apparatus according to claim 1, wherein the substrate comprises a semiconductor wafer having a thickness t (μm), Young's modulus E (MPa), wherein said plurality of concentrically circumferential walls being configured to define a plurality of pressurizing areas for pressing the semiconductor wafer, said plurality of pressurizing areas comprising a central pressurizing area located at a central part of said elastic membrane, an annular edge pressurizing area located at the outermost part of said elastic membrane, and a plurality of intermediate pressurizing areas located between said central pressurizing area and said annular edge pressurizing area; and wherein an area width of at least one of said intermediate pressurizing areas is set in a range to allow a polishing rate responsive width not to vary even when the area width is varied; and the area width of said at least one of said intermediate pressurizing areas is set in the range of not less than 2 mm and not more than EWb (mm) defined in the following formula:

$$EWb=15\times(t/775)^3\times(E/194000).$$

* * * * *